United States Patent [19]

DeVries et al.

[11] Patent Number: 4,502,741

[45] Date of Patent: Mar. 5, 1985

[54] FASTENER STORAGE AND DISPLAY RACK

[75] Inventors: Henry L. DeVries, Portage, Mich.; Myron A. Roth, Jr., St. Paul; William A. Roth, Lakeland, both of Minn.

[73] Assignee: Midwest Fasteners Corp., Kalamazoo, Mich.

[21] Appl. No.: 380,221

[22] Filed: May 20, 1982

[51] Int. Cl.[3] ..... A47B 87/02

[52] U.S. Cl. ..... 312/108; 108/102; 108/111; 211/126; 312/263; 312/348; 312/350

[58] Field of Search ..... 312/257 R, 108, 330 R, 312/350, 126, 9, 348, 263; 108/102, 111, 60; 211/71, 126, 133

[56] References Cited

U.S. PATENT DOCUMENTS

| | | | |
|---|---|---|---|
| 1,639,387 | 8/1927 | Seward | 108/102 |
| 1,669,185 | 5/1928 | Beiger | 312/330 |
| 1,800,052 | 4/1931 | Brumbaugh | 312/350 UX |
| 3,181,922 | 5/1965 | McBean | 312/234.1 |
| 3,221,677 | 12/1965 | Kerr | 108/102 |
| 3,265,935 | 8/1966 | Rosa | 317/101 |
| 3,288,301 | 11/1966 | Kent et al. | 211/41 |
| 3,494,685 | 2/1970 | Fiterman et al. | 312/108 |
| 3,529,878 | 9/1970 | Blowers | 312/107 |
| 3,567,300 | 3/1971 | Mari | 108/111 |
| 3,581,906 | 6/1971 | Joyce | 211/116 |
| 3,655,065 | 4/1972 | Yellin | 312/257 |
| 3,685,465 | 8/1972 | Haumer | 312/111 |
| 3,729,242 | 4/1973 | Barney | 312/108 |
| 3,730,605 | 5/1973 | Eckard | 312/257 |
| 3,779,623 | 12/1973 | Motohashi | 312/108 |
| 3,807,572 | 4/1974 | Luvara et al. | 312/108 |
| 3,836,217 | 9/1974 | Shiina | 312/257 R |
| 4,022,517 | 5/1977 | Eckert | 312/257 R |
| 4,043,625 | 8/1977 | Bleeker | 312/350 |
| 4,108,519 | 8/1978 | Chervenak | 312/320 |
| 4,171,150 | 10/1979 | Söderlund | 312/263 X |
| 4,232,916 | 11/1980 | Correia | 312/107 |

OTHER PUBLICATIONS

Midwest Fastener Corporation Refillable Fastener Assortment Catalog, pp. 2 & 3, including cover.

Sharon 1968 & 1969 Refillable Assortment Catalog, cover page, p. 2 and rear inside cover.

Sharon Bolt & Screw Co. Inc., Catalog A-79, cover page and pp. 2 & 3.

Arrow Star Buyers Discount Catalog 83-9, cover page and pp. 2, and 8-18.

*Primary Examiner*—William E. Lyddane
*Assistant Examiner*—Thomas A. Rendos
*Attorney, Agent, or Firm*—Fay & Sharpe

[57] ABSTRACT

The storage and display rack includes four like panel structures (A) and a plurality of dividers (B) mounted between opposite panel structures. Each panel structure includes an outer wall (30) from which a face portion (32), a rear edge portion (34), a tongue portion (36), a tongue receiving portion (38), and a plurality of rib pairs (40, 42, 44, 46, 48, 50, 60, 62) project inward. The face portion has breakout regions (86) which are adapted to be removed from panel structures disposed at the sides of the rack such that associate rib pairs slidably receive the dividers. Each divider has a display box supporting area (200), a display box retaining projection (206), an extra parts supporting area (202), a pair of guide edges (220, 222) which are slidably received in rib pairs of opposite side panels, and a handle (240) for facilitating manual sliding of the dividers.

17 Claims, 15 Drawing Figures

FIG. 14
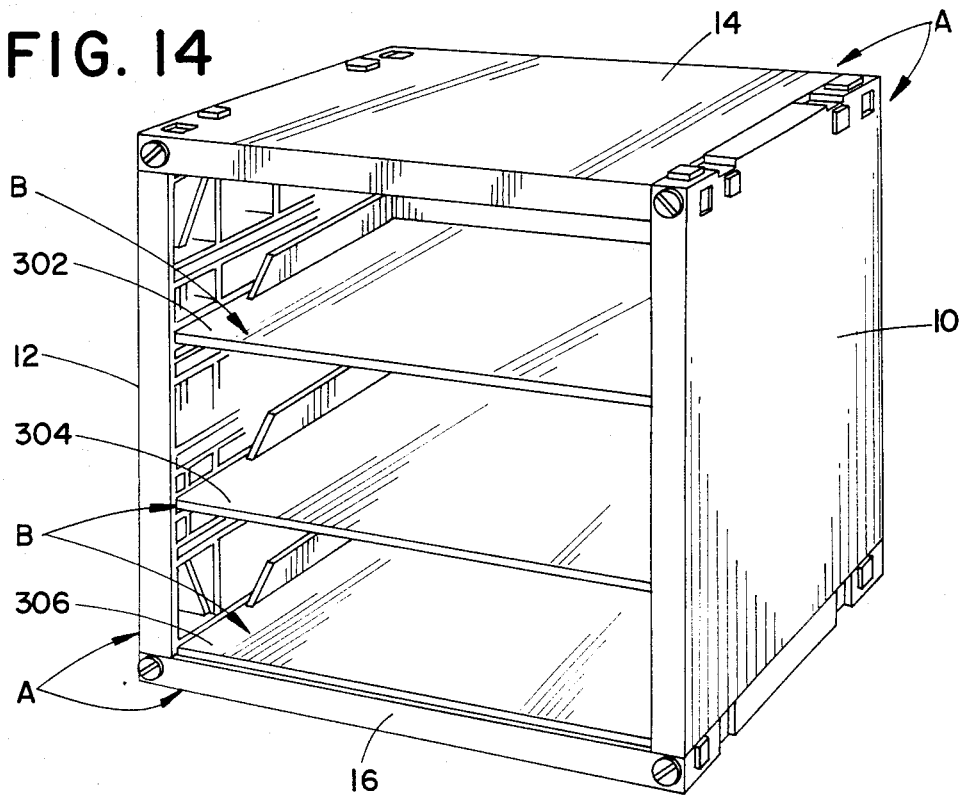
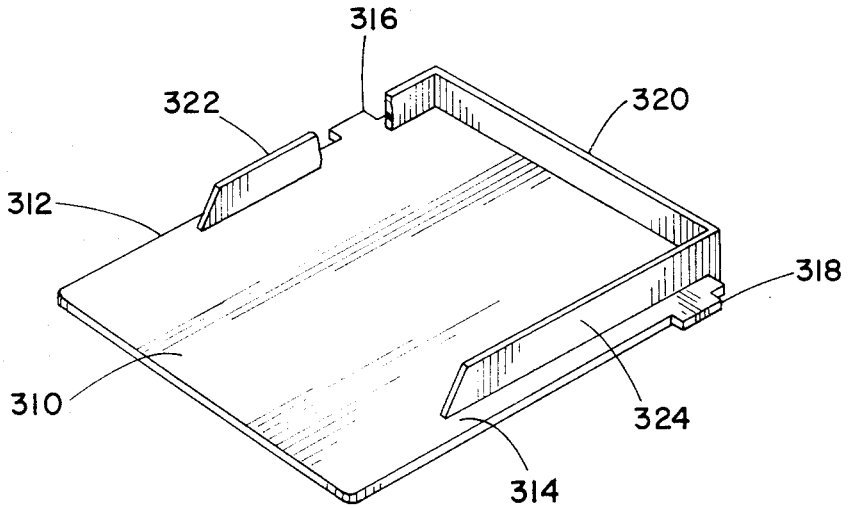
FIG. 15

FASTENER STORAGE AND DISPLAY RACK

BACKGROUND OF THE INVENTION

The invention pertains to the art of storage and display racks. The invention finds particular application in the storage and display of boxed assortments of fasteners, washers, springs, and other relatively small hardware and will be described with particular reference thereto. It is to be appreciated, however, that the invention has other applications including the storage and display of electrical components, sewing notions, jewelry, tobacconist's supplies, and the like.

In a common fastener merchandising system, assortment boxes each containing a plurality of refill boxes are displayed. The refill boxes are sized such that with their lids removed they fit into the assortment box in a regular array, effectively dividing the assortment box into compartments. A description of the fasteners in each compartment or refill box is printed on the lid of the assortment box. Most commonly, the assortment box contains an assortment of related fasteners such as wood screws of various sizes, flat washers of various sizes, aluminum fasteners of various types, and the like.

Hardware stores and other retailers commonly display the assortment boxes on shelves of a display rack. One prior art display rack is a wooden box with an open front. It has a plurality of horizontal channels cut into its side walls in which flat, masonite shelves are slidably disposed. One assortment box is glued to the front portion of the masonite shelf and a cardboard box or tray is glued toward the rear to provide a compartment for storing extra refill boxes. The wooden racks are adapted to be stacked to form a larger display. Another prior art display rack is of similar design but fabricated from sheet metal. In another embodiment, the shelves are non-slidably disposed in the rack and are adapted to support cardboard bins slidably thereon.

One of the problems encountered in the prior art display racks has been supporting the weight of the fasteners. Because the fasteners are relatively heavy, and the display racks are commonly stacked three or more high, each rack was required to support a relatively great amount of weight. This support required a sturdy and relatively expensive rack. These sturdy racks were frequently heavy themselves compounding the carried weight problem.

Another problem with the prior art racks resides in the difficulty encountered replacing assortment boxes. In time, the assortment boxes, which are constructed of cardboard, wear and need replacement. Ungluing the old box and gluing a new assortment box in its place is relatively labor intensive. Further, the residual glue build-up often makes it difficult to seat the new box flat and secure on the shelf. Often, it is necessary to replace the shelf as well as the assortment box.

Another problem with the prior art racks has been insuring stability in the stacked rack displays. Upon withdrawing a shelf to gain access to the assortment box, the center of gravity already on the front of the shelves is shifted further forward. This inherent uneven weight distribution within the racks coupled with the relatively great weight of the fasteners renders improperly stacked racks dangerous to retail customers.

The present invention contemplates a new and improved storage and display rack which overcomes the above referenced problems and others.

SUMMARY OF THE INVENTION

In accordance with a first aspect of the invention, there is provided a storage and display rack which includes first and second molded plastic side panel structures and top and bottom molded plastic panel structures connected with the side panel structures. Each of the panel structures includes: an outer wall; a plurality of longitudinally disposed pairs of ribs which project inward from the outer wall for providing rigidity and strength to the panel structure; a plurality of generally tranverse projections projecting inward from the outer wall between adjacent rib pairs for providing rigidity and strength to the panel structure; a face portion projecting inward from the outer wall along a tranverse edge of the panel structure; a tongue means extending along one longitudinal edge of the panel structure; and a generally U-shaped tongue receiving slot having an opening extending along the other longitudinal edge of the panel structure. The top, bottom, and side panel structures have their tongue means and tongue receiving slots interconnected such that the panel structures form a generally square cross-sectioned sleeve. At least one divider is disposed between corresponding rib pairs of oppositely disposed panel structures dividing the interior of the rack into at least two compartments.

In accordance with another aspect of the invention, there is provided a storage and display rack which includes first and second molded plastic side panel structures, top and bottom wall defining means, and a plurality of sliding shelves. Each of the side panel structures includes a plurality of substantially longitudinally disposed pairs of spaced inward projecting ribs. The rib pairs provide rigidity to the side panel structures and are adapted to support and guide the shelves for longitudinally sliding movement. A plurality of generally tranversely disposed inward projections extend between adjacent rib pairs to provide rigidity and loading strength. A stop portion projects inward between ribs in each rib pair to provide rigidity and loading strength to the panel structure and to limit sliding movement of the shelves. The top and bottom wall defining means constrain the first and second side panel structures in a fixed, spaced relationship with their rib pairs disposed substantially horizontal and parallel. Each of the sliding shelves includes a pair of generally linear guide edges which are disposed in sliding engagement with oppositely disposed rib pairs of the first and second side panel structures. At least one stop projection extends from the shelf for selectively engaging one of the stop portions for limiting sliding movement of the shelf. A handle means is disposed adjacent the front of the shelf to facilitate manual manipulation of the shelf.

One advantage of the present invention is that it provides a relatively strong storage and display rack which is relatively light in weight and inexpensive to manufacture.

Another advantage of the present invention is that it facilitates the interchanging and replacement of assortment boxes.

A further advantage of the present invention is that it facilitates and simplifies stacking a plurality of the storage and display racks.

Yet another advantage of the present invention is that it is aesthetically pleasing and attractive.

Still further advantages of the present invention will become apparent upon reading and understanding the following detailed description of the preferred embodiment.

BRIEF DESCRIPTION OF THE DRAWINGS

The invention may take form in various parts and arrangements of parts. The drawings are only for the purpose of illustrating a preferred and alternate embodiments and are not to be construed as limiting the invention.

FIG. 14 is a perspective view of an alternate embodiment of the display rack with a plurality of nonsliding dividers; and, FIG. 15 is a perspective view of a nonsliding divider in accordance with the present invention.

DETAILED DESCRIPTION OF THE PREFERRED AND ALTERNATE EMBODIMENTS

Figure 1:
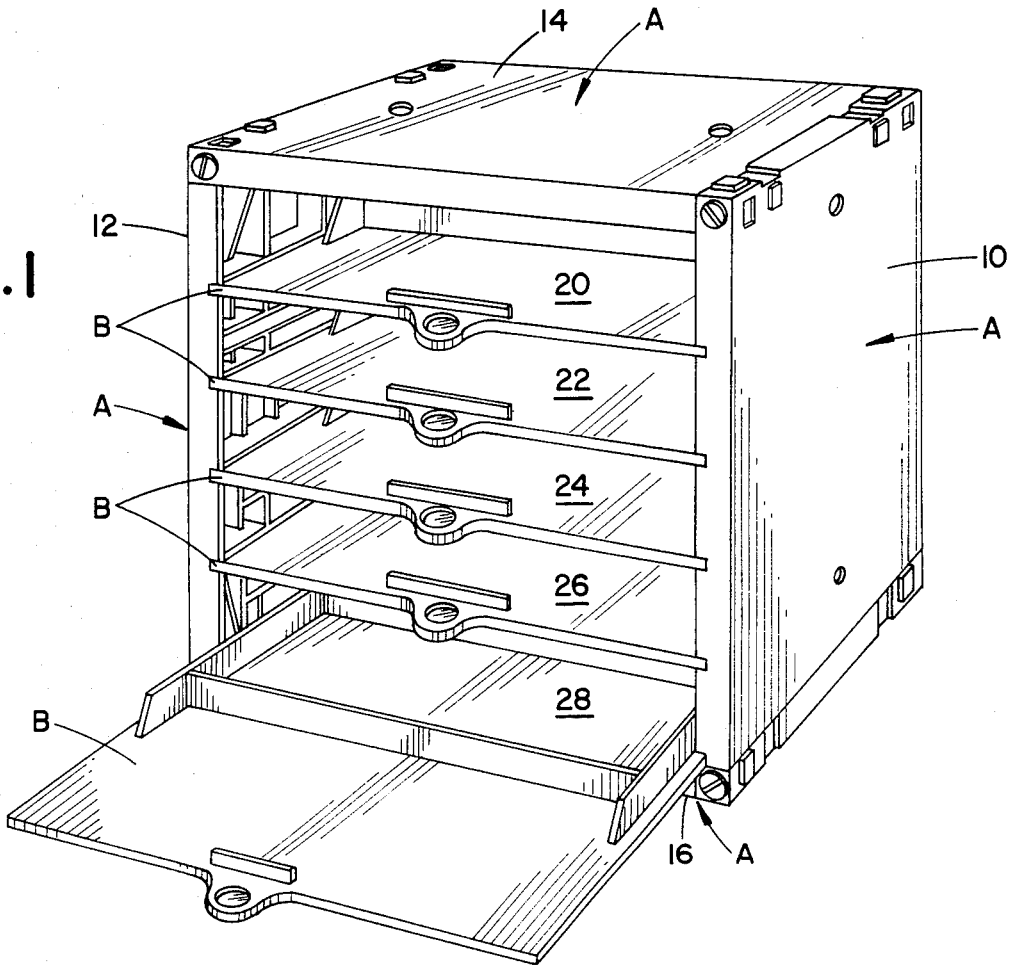
FIG. 1 is a perspective view of a display rack in accordance with the present invention.
Figure 2:
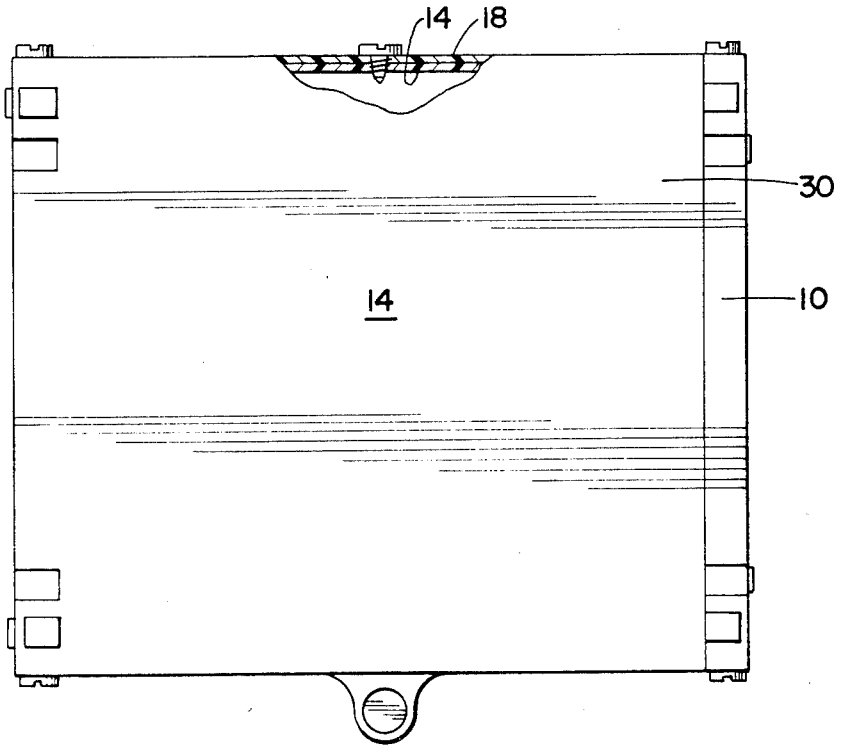
FIG. 2 is a top view of the display rack of FIG. 1.

With reference to FIG. 1, a storage and display rack includes four interconnected panel structures A disposed around its periphery and a plurality of dividers B disposed in the interior between the panel structures to divide the spaced defined thereby. The rack includes first and second side panel structures 10 and 12, a top panel structure 14, and a bottom panel structure 16. The top, bottom, and side panel structures are connected together to form a sleeve having a rectangular, and more specifically a square cross-section transverse to a longitudinal axis and an open face disposed transversely at one side of the rack. A rear panel structure 18 (FIG. 2) closes the transverse side opposite to the open face. The dividers include a plurality of shelves 20, 22, 24, 26, and 28 which, in the embodiment of FIG. 1, are slidably mounted between the side panel structures. This enables the sliding shelves to be withdrawn, as illustrated by shelf 28, to facilitate access to that which is stored and displayed on the shelf.

Because each of the panel structures is constructed substantially the same, FIGS. 3–8 describe an exemplary one of the panel structures and it is to be appreciated that the description applies to each of the panel structures 10, 12, 14, and 16. Each of the panel structures includes a generally smooth and flat outer wall 30 which is particularly adapted to be imprinted with trademarks and other advertising materials. A face portion 32 projects inward from the outer wall along one transverse edge of the panel structure. A rear edge portion 34 extends inward from the opposite transverse edge. A tongue means 36 extends along one longitudinal edge of the panel structure and a tongue receiving means 38 extends along the other longitudinal edge.

A first plurality of longitudinally disposed rib or projection pairs 40, 42, 44, 46, 48, and 50 project inward from the outer wall 30 and extend longitudinally between the face portion 32 and the rear edge portion 34. The rib pair 40 includes a rib 40*a* and a second rib 40*b*; the rib pair 42 includes a first rib 42*a* and a second rib 42*b*; and so forth. The first plurality of rib pairs is disposed symmetrically with respect to the longitudinal edges of the panel structure. Because each panel structure has a tongue means on one end and a tongue receiving means on the other end, when assembled, the tongue means will be on the upward edge of one of the side panels and the tongue receiving means will be on the upward edge of the other side panel. By symmetrically placing the rib pairs, the rib pair 40 of one side panel is disposed, when assembled, parallel and level with the rib pair 50 of the other side panel. Similarly, rib pairs 42 and 48 and rib pairs 44 and 46 are disposed horizontal and level with each other in the opposite side panel structures. The longitudinal rib pairs provide rigidity and strength to the panel structures. When the panel structures are arranged vertically as side panel structures, the rib pairs function as beams to distribute the load.

A second plurality of rib or projection pairs including rib pair 60 with ribs 60*a* and 60*b* and rib pair 62 with ribs 62*a* and 62*b* are disposed symmetrically parallel to at least rib pairs 40 and 50 in each panel structure. The second plurality of rib pairs provides for a second divider spacing. In the preferred embodiment, the first plurality of rib pairs 40*a* and *b*, 42*a* and *b*, 46*a* and *b*, 48*a* and *b*, and 50*a* and *b* are particularly adapted to receive five symmetrically spaced sliding shelf dividers and the second plurality of rib pairs 60*a* and *b*, 62*a* and *b*, and 50*a* and *b* are particularly adapted to receive three symmetrically spaced stationary shelf dividers.

Figure 3:
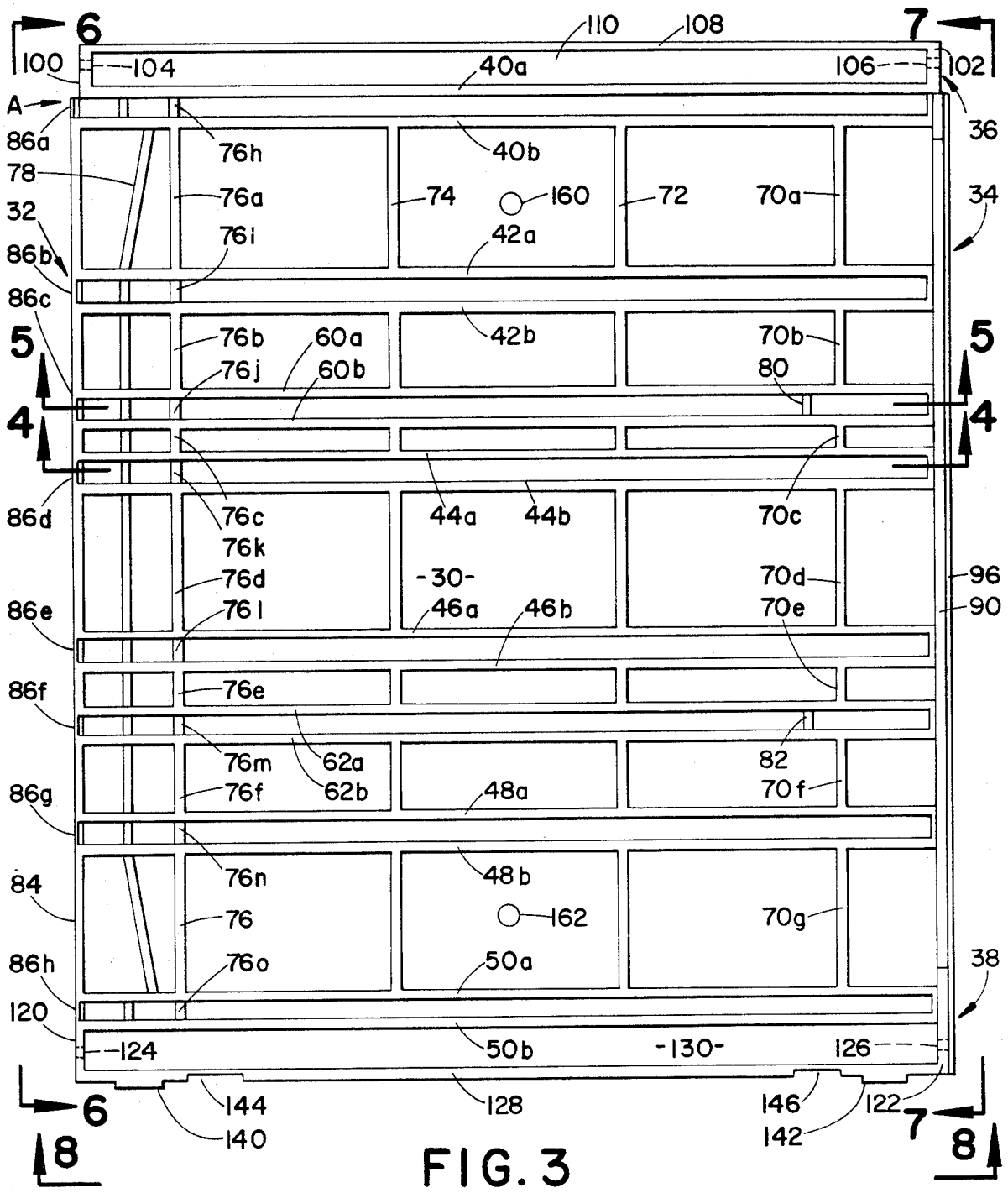
FIG. 3 is a plan view of one of the panel structures of the display rack of FIG. 1.
Figure 4:
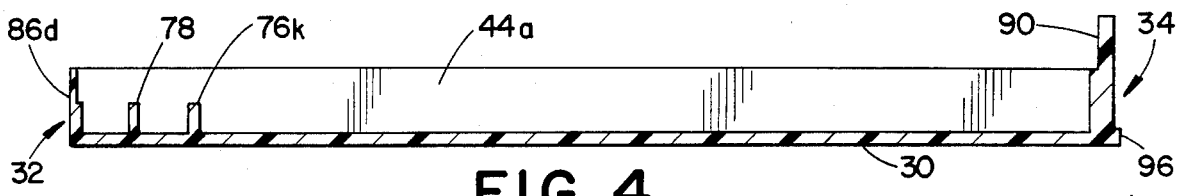
FIG. 4 is a sectional view through section 4—4 of FIG. 3.
Figure 5:
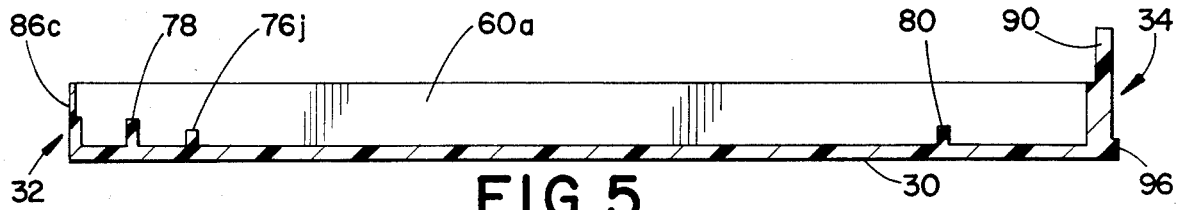
FIG. 5 is a sectional view through section 5—5 of FIG. 3.

A plurality of generally transverse ribs or projections project inward from the outer wall between adjacent rib pairs. In the preferred embodiment, the generally transverse projections are disposed substantially perpendicular to the longitudinal rib pairs. The projections extend discontinuously between adjacent rib pairs, i.e., from one pair to the next pair, but not within each rib pair, i.e., from one rib to the other rib of the same pair. Alternately, the transverse projections may be disposed obliquely to the transverse and longitudinal edges of the panel structure to form a more truss-like pattern between adjacent rib pairs. A rear most transverse projection 70 includes a plurality of transverse projection portions 70*a*, 70*b*, 70*c*, 70*d*, 70*e*, 70*f*, and 70*g* intermittently extending between the rib pairs. A plurality of intermediate transverse projections, including transverse projections 72 and 74 similarly extend intermittently between adjacent rib pairs from rib pair 40 to rib pair 50. With particular reference to FIGS. 3 and 4, a forward transverse projection 76 includes a plurality of rib sections 76*a*, 76*b*, 76*c*, 76*d*, 76*e*, 76*f*, and 76*g* extending between adjacent rib pairs. Further, the forward transverse rib 76 includes a plurality of stop portions 76*h*, 76*i*, 76*j*, 76*k*, 76*l*, 76*m*, 76*n*, and 76*o* extending within each rib pair. The stop portions provide rigidity and loading strength to the panel structure as well as limit sliding movement of the sliding shelves. To provide further rigidity and loading strength adjacent the more heavily loaded face edge of side panel structures, a supplemental forward projection 78 extends from rib pair 40 to rib pair 50 between and within the rib pairs intermediate the forward rib 76 and the face portion 32. With reference to FIGS. 3 and 5, the rib pairs 60 and 62 include stop or locking portions 80 and 82, respectively, adjacent the rear edge portion for locking shelves nonslidingly in the rib pairs.

Figure 6:
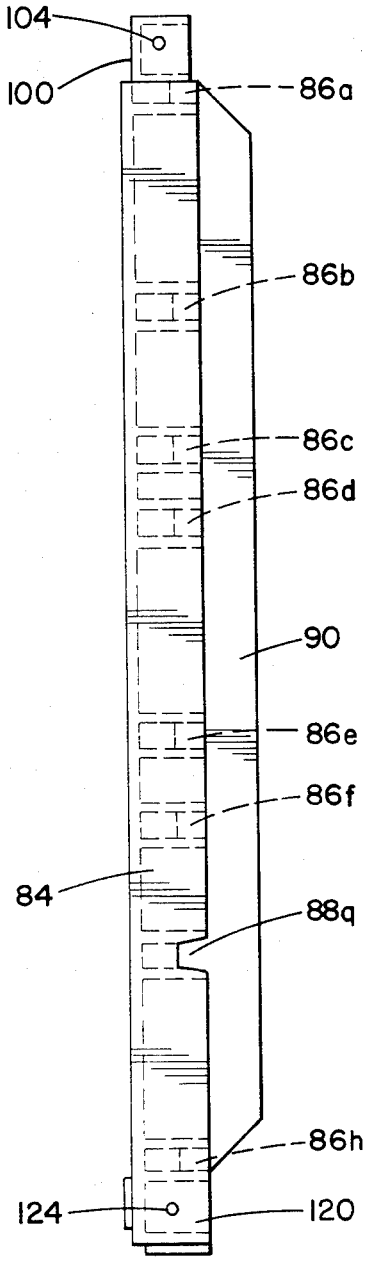
FIG. 6 is a front view of the panel structure of FIG. 3.

With particular reference to FIGS. 3 and 6, the face portion 32 includes a flat, finished front surface 84 which provides the rack with an aesthetically pleasing appearance. The face portion is sufficiently thick that it provides strength and rigidity to the panel structure. The face portion 32 includes a plurality of thin, breakout regions 86*a*–86*h*. Within each rib pair, particularly of the first plurality of rib pairs, and extending from the height of the stop portions to the inner surface of the outer wall 30. To allow the shelves to slide, the breakout regions 86 are grasped with a pair of pliers or the like, and broken out or removed to create channels 88, such as exemplary channel 88*g* (FIG. 6), in the face portion in alignment with each rib pair which is to receive a sliding shelf.

Figure 7:
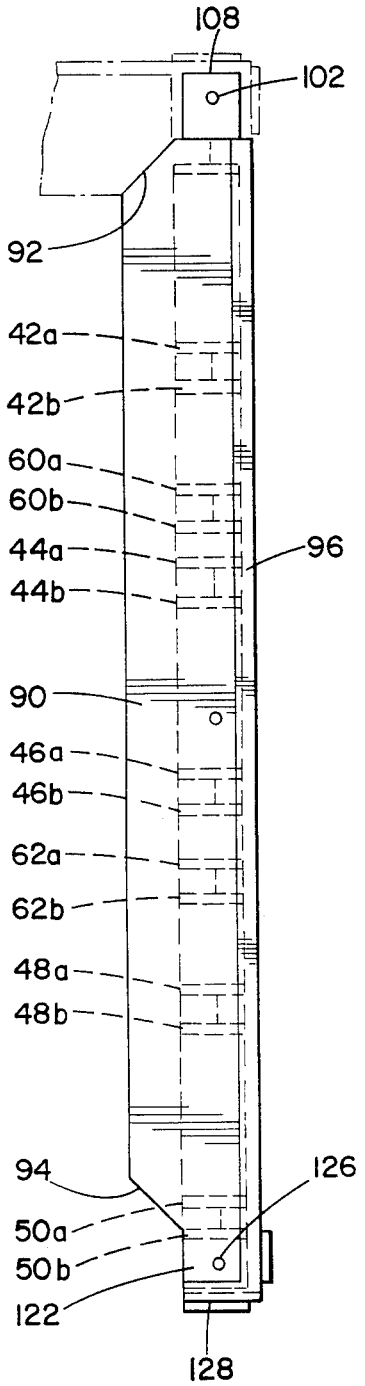
FIG. 7 is a rear view of the panel structure of FIG. 3.

With particular reference to FIGS. 3 and 7, the rear edge portion 34 includes a rear edge or face 90 having bevelled edges 92 and 94 to facilitate interlocking with adjacent panel structures. A ledge 96 projects rearward to provide a lip or recess for receiving the rear panel 18. The projection of the ledge 96 is commensurate with the thickness of the rear panel such that the rear panel is mounted flush with the ledge.

With particular reference to FIG. 3, the tongue means 36 includes a pair of oppositely disposed end portions 100 and 102 each having an aperture 104 and 106, respectively, therein. The tongue end portions are recessed inward from the transverse edges, the outer wall, and the inner surface of the ribs and projections by a dimension corresponding to the thickness of the tongue receiving means 38. The tongue means further includes a tongue longitudinal wall 108 and a tongue outer wall 110 for greater strength and rigidity.

Figure 8:
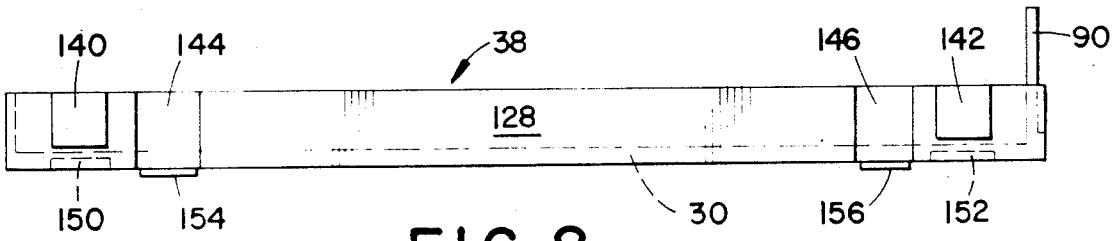
FIG. 8 is a bottom view of the panel structure of FIG. 3.

With particular reference to FIGS. 3 and 8, the tongue receiving means 38 includes end walls 120 and 122 having apertures 124 and 126 therethrough. A longitudinal wall 128 extends between the end walls 120 and 122 to be flush with and form an extension of the outer wall of a panel received in the tongue receiving means 38. The outer wall 30 includes a portion 130 which extends to the tongue receiving portion longitudinal wall 128 for greater strength and rigidity. In this manner, the tongue receiving means defines a generally U-shaped slot having a face opening disposed perpendicular to the outer wall, i.e. perpendicular to both the longitudinal and transverse directions. This facilitates the interconnection of the panel structures perpendicular to each other.

To facilitate interconnecting display racks in a stable wall display, each of the panel structures has a plurality of symmetrically disposed outward projecting tabs and inward recessed depressions which mate to improve the stability of interconnected racks. Specifically, the longitudinal tongue receiving wall 128 includes a pair of outward tabs of a first cross-section 140 and 142 as well as a pair of inward depressions 144 and 146 of a second cross-section. Adjacent the longitudinal tongue receiving wall 128, the outer wall 30 has a pair of depressions 150 and 152 of the first cross-section and a pair of tabs 154 and 156 of the second cross-section. This anti-symmetric arrangement permits the depressions of one rack to receive the tabs of an adjacent rack and vice versa. In this manner, the tabs and depressions interlock to protect against slippage and misalignment. Further, a pair of symmetrically disposed apertures 160 and 162 in the outer wall 30 enable adjacent racks to be bolted together.

Figure 9:
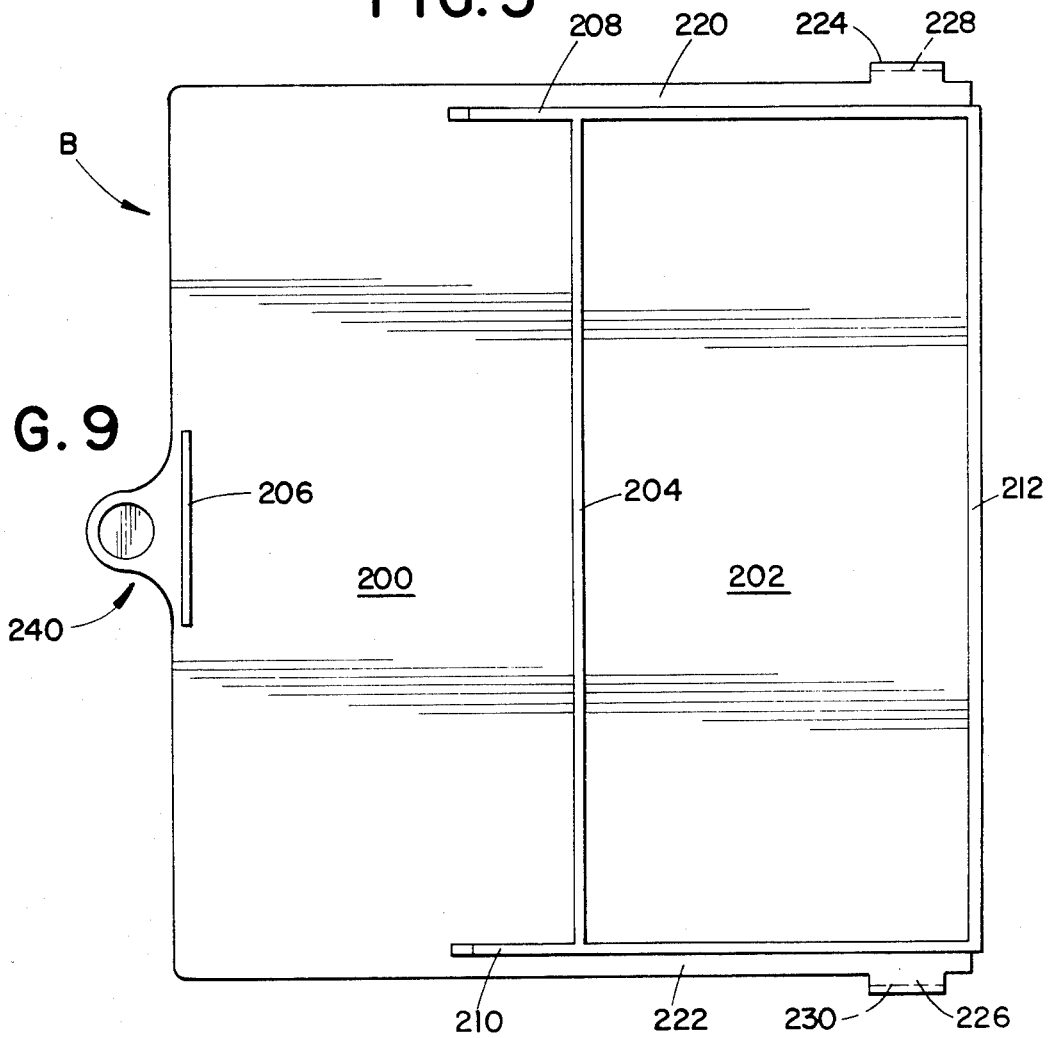
FIG. 9 is a plan view of a sliding shelf of FIG. 1.
Figure 10:
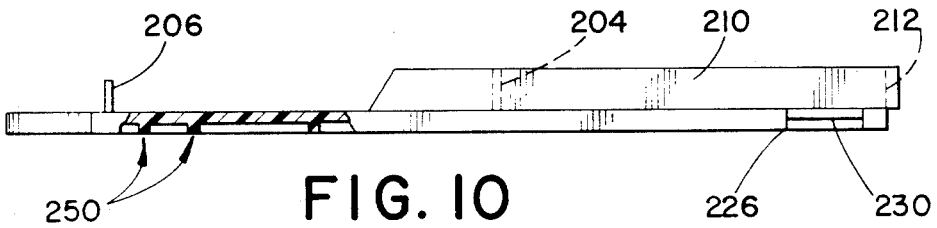
FIG. 10 is a side view in partial section of the shelf of FIG. 9.

With reference to FIGS. 9 and 10 a sliding shelf type divider B of the embodiment of FIG. 1 is illustrated in greater detail. The sliding shelf includes a generally flat display box supporting area 200 toward the front and an extra parts supporting area 202 toward the rear. The shelf includes a display box positioning and mounting means including a divider wall 204 to the rear of the display box supporting area and an upstanding projection 206 toward the front of the display box supporting area to position the display box relative to forward and reverse movement. To either side of the display box supporting area are longitudinally extending segments of walls 208 and 210 which limit transverse movement of the display box. Alternately, other display box mounting and positioning means such as an upward projecting detent which passes into the interior of the display box and engages an inner wall surface, one or more apertures which are adapted to receive snap fitting which have passed through a lower wall of the display box, or the like.

The extra parts supporting area 202 is defined by the divider wall 204 to one side a rear wall 212 to the other and edge walls 208 and 210. In this manner, the sliding shelf includes a permanent spare parts retaining area.

To facilitate sliding movement of the shelf, the shelf includes first and second guide edges 220 and 222 which are adapted to be received between the rib pairs in sliding engagement therewith. The guide edges are adapted to slide along the inner edge of the break away areas 88 and the stop portions 76 of the oppositely disposed side walls to maintain the shelf in alignment. A pair of stop projections 224 and 226 project outward from the guide surface to engage the stop portions to limit the sliding movement of the shelf. Adjacent their outer ends, the stop projections have thin regions 228 and 230 of reduced cross-section. The stop projection reduced cross-section regions are dimensioned for slidingly engaging the inner surface of the outer wall 30 to maintain the shelf in alignment. By reducing the width of the stop projection, the frictional drag is reduced correspondingly. In this manner, the sliding shelves are maintained in alignment with relatively few points of contact with the panel structures to facilitate easy sliding movement. A handle structure 240 is connected with the forward end of the shelf to facilitate manual gripping and manipulation of the shelf for manually sliding it fore and aft. To give the shelf greater strength and rigidity, a grid of reinforcing projections 250 are integrally formed with the lower surface of the shelf.

Figure 11:
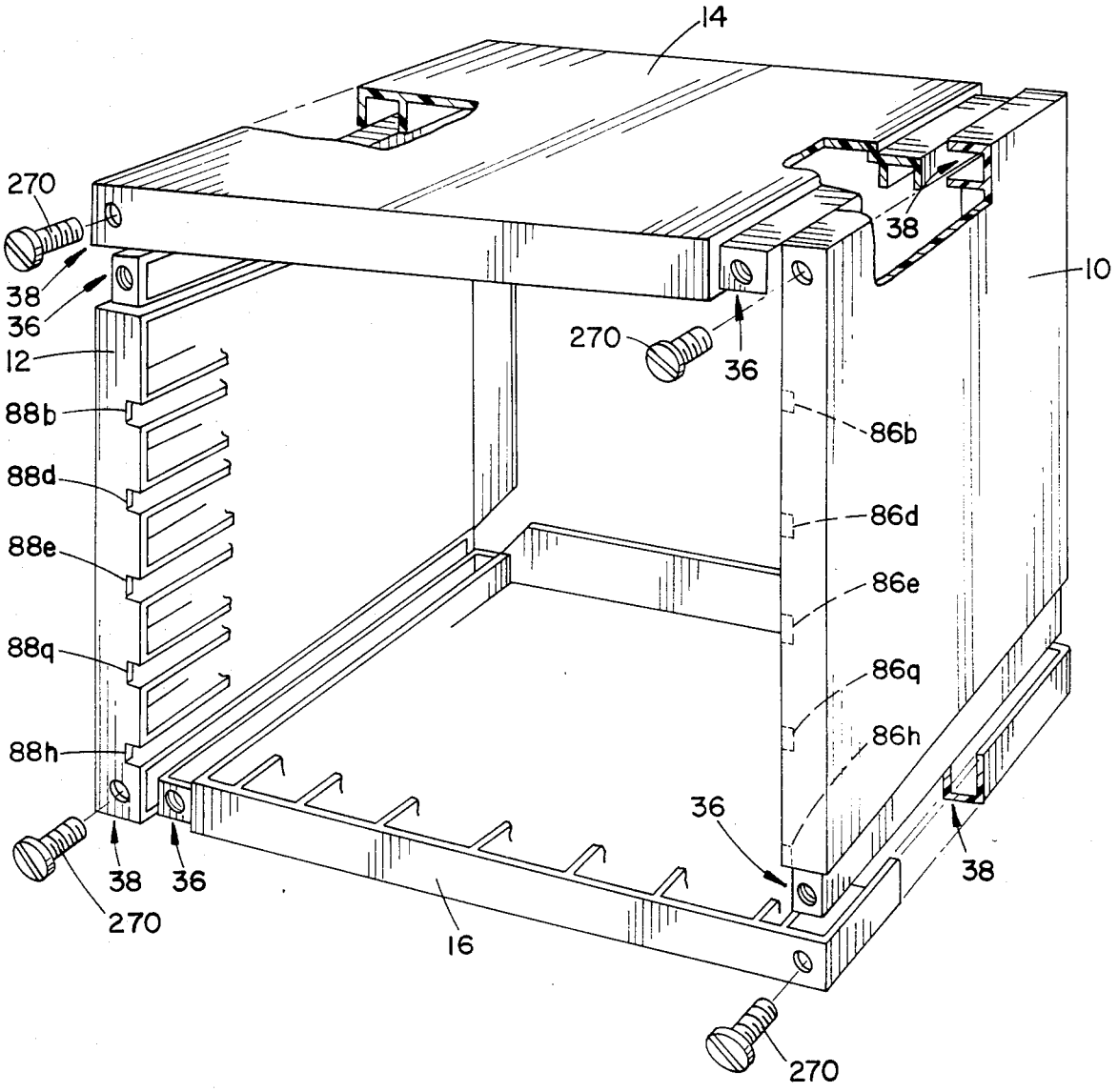
FIG. 11 is a perspective view illustrating the interconnection of the panel structures.
Figure 12:
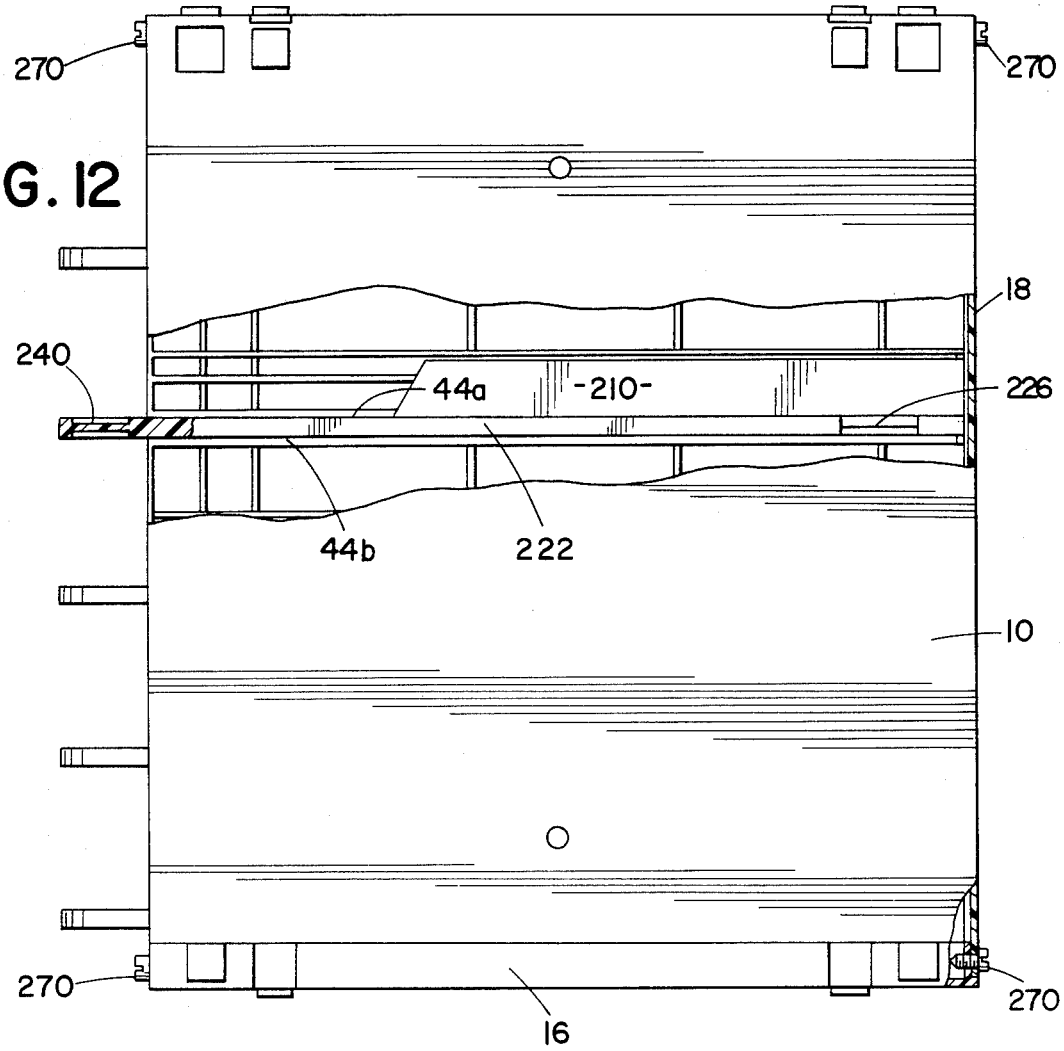
FIG. 12 is a side view in partial section of the rack of FIG. 1.
Figure 13:
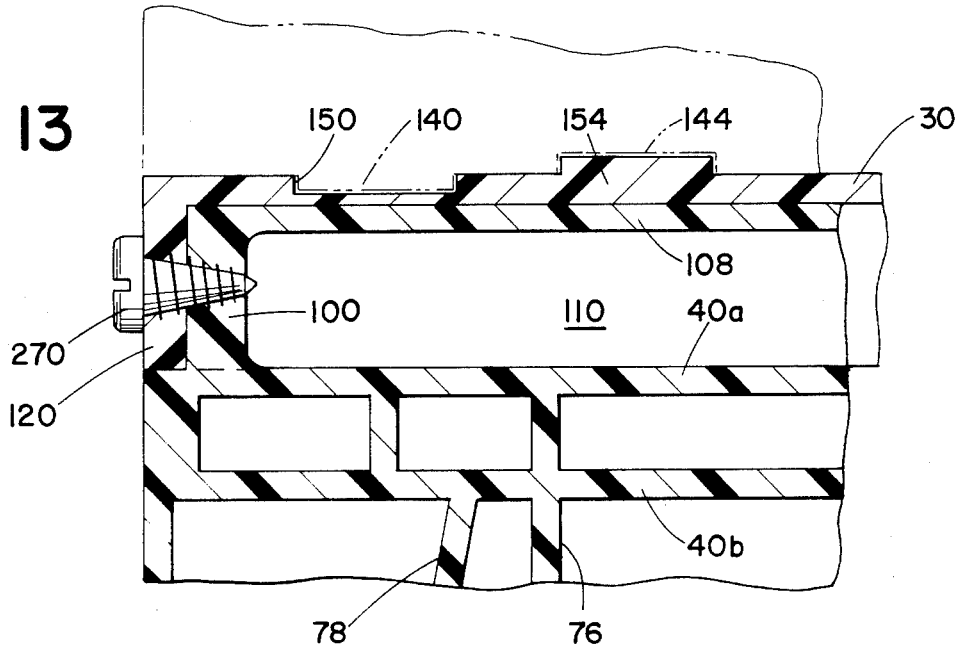
FIG. 13 is a sectional view which illustrates the interconnection of panel structures.

With primary reference to FIG. 11 and secondary reference to FIGS. 12 and 13, to assemble the storage and display rack, the weakened breakout regions 86 adjacent the rib pairs which are to receive sliding shelves are broken away with pliers or the like. In FIG. 11, the breakout regions of side wall 12 have been broken away to form channels 88 and the breakout regions 86 of wall 10 have yet to be broken away. The tongue means 36 of the side panel structure 10 and bottom panel structure 16 are partially inserted into the tongue receiving means 38 of the bottom panel structure 16 and the side panel structure 12, respectively. With reference to FIG. 12, the sliding shelves are positioned in the rib pairs corresponding to the channels 88 which have been broken away. The tongue means and tongue receiving means of the top panel structure are brought into engagement with the tongue receiving means and tongue means of the side panel structures, respectively. With reference to FIG. 13, the tongue and tongue receiving means are brought into full engagement and a plurality of fasteners 270 are threaded into the matching front and rear apertures of the tongue and tongue receiving means. The rear panel 18 is positioned against the rear edge portion and held in place with the rear fasteners. Assortment boxes are positioned on the assortment box supporting area 200 and spare refill boxes on the extra parts supporting area 202.

With reference to FIG. 14, the storage and display rack is also adapted to support a plurality of bins. In the embodiment of FIG. 14, the bins are slidably positioned on stationary dividers 302, 304, and 306. The construction of the top, bottom and side panel structures is the same as described in conjunction with the embodiment of FIG. 1. However, during the assembly, the breakout regions 86 remain intact and are not removed.

With reference to FIG. 15, the nonsliding shelf dividers include a bin supporting surface 310. Nonsliding guide surfaces 312 and 314 are received between rib pairs. The forward edge of the bin supporting surface engages the rear of the breakout regions to prohibit the nonsliding shelves from sliding. Further, stop projections 316 and 138 project outward from the nonsliding guide surfaces to engage the step or locking portions 80 and 82 (FIGS. 3 and 5). Rear and side upstanding walls 320, 322, and 324 extend upward from the bin supporting surface around the sides and back periphery of the nonsliding shelf. A grid of downward projections extend downward from the bottom of the nonsliding shelf to provide greater strength and rigidity.

The invention has been described with reference to the preferred and alternate embodiments. Obviously, modifications, alterations, and other embodiments will occur to others upon reading and understanding the preceding detailed description. It is intended that the invention be construed as including all such alterations, modifications, and alternate embodiments insofar as they come within the scope of the appended claims or the equivalents thereof.

Having thus provided a detailed descriptin of a structure embodying the invention, the invention is now claimed to be:

1. A storage and display rack comprising:

(a) first and second molded plastic side panel structures, each including:

(i) a plurality of substantially longitudinal disposed pairs of spaced, inward projecting ribs, the rib pairs providing rigidity to the side panel structure and being adapted to support and guide longitudinally slidable shelves;

(ii) a plurality of inward projections extending between adjacent rib pairs, the projections providing rigidity and loading strength to the side panel structures;

(iii) an inward projecting face portion, the face portion being connected substantially normal to the longitudinal rib pairs along a transverse edge of the panel structure, the face portion having weakened, breakout regions between the longitudinal ribs within each pair;

(b) top and bottom wall defining means for constraining the first and second side panel structures in a fixed, spaced relationship with corresponding rib pairs in the first and second panel structures being disposed substantially horizontal and parallel; and, (c) a plurality of slidable shelves, each shelf including:

(i) a pair of generally linear guide edges disposed in sliding engagement with the corresponding oppositely disposed rib pairs of the first and second side panel structures, the guide edges having forward ends disposed adjacent face portion breakout regions such that an unremoved breakout region holds the adjacent shelf against sliding movement.

2. The rack as set forth in claim 1 wherein the first and second side panels further include a tongue means disposed longitudinally along one edge of each panel structure and a tongue receiving means disposed longitudinally along another edge of each panel structure, the tongue means and tongue receiving means being dimensioned such that the tongue means of one panel structure is receivable in the tongue receiving means of another panel structure.

3. The rack as set forth in claim 2 wherein the tongue means projects generally transversely and the tongue receiving means includes a generally U-shaped slot with a longitudinally extending opening facing normal to the plane of the panel structure.

4. The rack as set forth in claim 2 wherein one of the tongue means and tongue receiving means faces generally transversely and the other faces generally normal to the transverse and longitudinal directions such that the tongue means and tongue receiving means connect panel structures substantially normal to each other.

5. The rack as set forth in claim 4 wherein the top and bottom wall defining means each include panel structures of substantially identical construction to the side panel structures.

6. A storage and display rack comprising:

(a) first and second molded plastic side panel structures, a top molded plastic panel structure, and a bottom molded plastic panel structure, the top and bottom panel structures being connected with the side panel structures, each panel structure including:

(i) an outer wall;

(ii) a plurality of longitudinally disposed pairs of ribs which project inward from the outer wall for providing rigidity and strength to the panel structure, the rib pairs being symmetrically disposed relative to a transverse direction;

(iii) a plurality of projections which project inward from the outer wall between adjacent rib pairs for providing rigidity and strength to the panel structures;

(iv) a face portion projecting inward from the outer wall along a transverse edge of the panel structure, the face portion being connected with the rib pairs, each face portion having weakened breakout regions between the ribs within each pair, removal of breakout regions providing access channels through which dividers are slidable;

(v) a tongue means disposed along a longitudinal edge of the panel structure and a tongue receiving slot having an opening disposed along the other longitudinal edge of the panel structure, the tongue and tongue receiving slot being disposed relative to each other such that interconnecting the tongue means from one panel structure with the tongue receiving slot of another interconnects the two panel structures perpendicular to each other;

(b) the top, bottom, and side panel structures having their tongue means and tongue receiving slots interconnected such that the panel structures form a generally square cross-sectioned sleeve; and, (c) at least one divider disposed between corresponding rib pairs of oppositely disposed panel structures, whereby the interior of the rack is divided into at least two compartments.

7. The rack as set forth in claim 6 wherein on each panel structure the rib pairs are arranged in a first symmetric group and a second symmetric group such that dividers can be disposed with the spacing of the first or second group.

8. The rack as set forth in claim 6 wherein each outer wall has symmetric tabs and depressions such that tabs and depressions of the rack interact with depressions and tabs of another like rack to promote stability as the rack is stacked with other like racks.

9. The racks as set forth in claim 6 further including a square back panel connected with a transverse edge of each panel structure opposite to the face portion.

10. The rack as set forth in claim 6 wherein the divider includes a pair of guide edges which are disposed between corresponding rib pairs of the side panel structures.

11. The rack as set forth in claim 10 wherein the divider includes a display box supporting surface generally adjacent the panel structure face portions and an upstanding wall extending around the rear of the divider.

12. The rack as set forth in claim 11 wherein the divider includes a display box retaining means for retaining a display box positioned on the display box supporting surface.

13. The rack as set forth in claim 11 wherein the divider includes a projection for engaging the side panel structures to limit sliding movement.

14. The rack as set forth in claim 6 wherein the divider includes a stop projection and the side panels include locking projectios for engaging the stop projection to lock the divider against sliding movement.

15. A storage and display rack comprising:

(a) first and second molded plastic side panel structures, each including:

(i) a plurality of substantially longitudinal disposed pairs of spaced, inward projecting ribs, the rib pairs providing rigidity to the side panel structure and being adapted to support and guide longitudinally slidable shelves;

(ii) a plurality of inward projections extending between adjacent rib pairs, the projections providing rigidity and loading strength to the side panel structures;

(iii) a plurality of stop ribs, each of the stop ribs projecting inward between ribs of one of the rib pairs, the stop ribs projecting inward less than the rib pairs, the stop ribs providing rigidity and loading strength to the panel structure and being adapted to limit movement of sliding shelves;

(b) top and bottom wall defining means for constraining the first and second side panel structures in a fixed, spaced relationship with corresponding rib pairs in the first and second panel structures being disposed substantially horizontal and parallel; and, (c) a plurality of slidable shelves, each shelf including:

(i) a pair of generally linear guide edges disposed in sliding engagement with the corresponding oppositely disposed rib pairs and stop ribs of the first and second side panel structures, such that the guide edges slide on the rib pairs and between the stop ribs of the first and second side panel structures;

(ii) at least one stop projection disposed adjacent and extending outward from at least one of the guide edges, the stop projection being disposed in sliding engagement with corresponding oppositely disposed ribs pairs of the first and second side panel structures and in a selectively abutting relationship with the stop rib for limiting sliding movement of the sliding shelf;

(iii) handle means to facilitate manual gripping of the shelf.

16. The rack as set forth in claim 15 wherein each sliding shelf includes a display box supporting area adjacent the handle means and a parts supporting area behind the display box supporting area.

17. The rack as set forth in claim 16 wherein each sliding shelf includes a divider wall between the display box and parts supporting areas.

* * * * *